US005816513A

United States Patent [19]

Spahlinger

[11] Patent Number: 5,816,513

[45] Date of Patent: Oct. 6, 1998

[54] YARN TAKEUP APPARATUS & METHOD

[75] Inventor: Jorg Spahlinger, Wermelskirchen, Germany

[73] Assignee: Barmag AG, Remscheid, Germany

[21] Appl. No.: 833,043

[22] Filed: Apr. 3, 1997

[30] Foreign Application Priority Data

Apr. 4, 1996 [DE] Germany ..... 196 13 490.0

[51] Int. Cl.[6] ..... B65H 54/02

[52] U.S. Cl. ..... 242/35.5 T; 242/18 A; 242/18 DD

[58] Field of Search ..... 242/18 A, 35.5 T, 242/18 DD

[56] References Cited

U.S. PATENT DOCUMENTS

| | | | |
|---|---|---|---|
| 3,857,522 | 12/1974 | Fink | 242/18 A |
| 3,921,922 | 11/1975 | Wust | 242/18 A |
| 3,941,321 | 3/1976 | Bosshard et al. | 242/18 A |
| 4,298,171 | 11/1981 | Fluckiger et al. | 242/18 A |
| 4,398,676 | 8/1983 | Koppen et al. | 242/18 A |
| 4,552,313 | 11/1985 | Sasaki | 242/18 A |
| 5,029,762 | 7/1991 | Behrens et al. | 242/18 A |
| 5,526,995 | 6/1996 | Westrich et al. . | |

FOREIGN PATENT DOCUMENTS 43 21 111 6/1993 Germany .

*Primary Examiner*—Michael Mansen

*Attorney, Agent, or Firm*—Bell Seltzer Intellectual Property Law Group of Alston & Bird LLP

[57] ABSTRACT

A yarn takeup apparatus for winding a continuously advancing yarn into yarn packages and which has a rotatable winding turret which supports for rotation two winding spindles. By the rotation of the winding turret, the winding spindles are moved alternately to a winding range and a doffing range. To this end, the winding spindles are mounted on the winding turret such that the spindles are movable relative to the winding turret respectively between a radially outer position and a radially inner position by a moveable spindle mount. At the beginning of the winding operation, the winding spindles are in the outer position, and during the build of the package, an evasive movement of the winding spindle is performed by movement of its mount and/or rotation of the winding turret.

21 Claims, 8 Drawing Sheets

YARN TAKEUP APPARATUS & METHOD

BACKGROUND OF THE INVENTION

The present invention relates to a takeup apparatus and method for winding a continuously advancing yarn into yarn packages.

DE-OS 43 21 111 discloses a yarn takeup apparatus wherein the winding spindles are rotatably supported on rocker arms. The rocker arms are mounted by means of swivel joints to a winding turret. By the rotation of the winding turret, the winding spindles are moved alternately from a winding range to a doffing range. To this end, the winding spindles are held for winding in an inner position on the winding turret and, for doffing, they are moved radially outward to an outer position. In this operation, the time for doffing the full packages from a stationary position is dependent on the winding speed and the evasive movement of the contact roll. At the normally high winding speeds of more than 6,000 m/min. and with a stationary contact roll, the doffing times are thus very short.

U.S. Pat. No. 4,298,171 discloses a takeup machine, wherein the winding spindles are likewise rotatably supported on rocker arms, and wherein the rocker arms themselves are mounted on the winding turret by means of swivel joints. In this takeup machine, the winding spindle is moved in the winding range by means of the rocker arm to a position on the winding turret, which ensures that for winding the yarn, the winding spindle is driven by means of a driven friction roll. Thereafter, as the diameter of the package being wound increases, the winding turret is rotated against a torque that becomes operative on it. Because of the stationary friction roll, a collision is bound to occur very rapidly between the full package in the doffing range and the package being wound in the winding range.

In the known yarn takeup machines, the center distance between the contact roll or friction roll and the winding spindle increases during the winding as a result of the rotation of the winding turret. In this process, the winding spindle is guided along a defined, circular path. As the center distance increases or the package becomes larger, a change occurs in the radial contact pressure between the contact roll and the package being formed. On the one hand, these changes result from the geometrical change between the contact roll and the winding spindle, and on the other hand from the increasing weight of the package.

It is accordingly the object of the present invention to further develop a yarn takeup machine of the type having a winding turret, and such that the package doff can be performed within a period of time which is independent of the evasive movement of the contact roll. Furthermore, it is an object of the invention to provide a takeup machine, wherein the radial contact pressure of the contact roll on the package remains largely constant in the course of the winding cycle.

SUMMARY OF THE INVENTION

The above and other objects and advantages of the present invention are achieved by the provision of a yarn winding apparatus and method which comprises a winding turret mounted to a machine frame for rotation about a central axis, rotary drive means for rotating the winding turret about the central axis, and means mounting two winding spindles on the winding turret for rotation about respective axes which are parallel to the central axis, with the spindles being adapted for alternate movement between a winding range and a doffing range by rotation of the winding turret about said central axis. The mounting means for each of the spindles includes a spindle mount mounted for movement on the winding turret so that the associated spindle may be moved between a radially outer position and a radially inner position. Spindle drive means is also provided for moving each of the spindle mounts so that the associated spindles may be moved between the outer and inner positions, and a contact roll is mounted to the frame so as to be in circumferential contact with a package being wound on a spindle in said winding range. The rotary drive means and the spindle drive means are controlled such that each of the spindles may be moved to the winding range and then moved to increase the distance of the spindle from the contact roll as the package builds.

In the yarn takeup machine of the present invention, the winding spindles are moved on the winding turret such that, at the beginning of the winding cycle, the winding spindles are in an outer position, and the evasive movement of the winding spindle for winding the package can be performed by the mount of the winding spindle and/or by the winding turret. From this results the special advantage that the evasive movement is ensured at the beginning of the winding cycle by the mount of the winding spindle. Meanwhile, the winding turret remains in its position, so that the winding spindle with the full package thereon that is kept ready for doffing remains stopped in a stationary doffing position. Since in the doffing range the winding spindle is likewise moved to the outer position, it is avoided that the package being wound and the full package in the doffing range interfere with one another.

After the full package in the doffing range has been doffed from its winding spindle being in this range and is replaced with an empty tube, the evasive movement of the winding spindle in the doffing range for winding the package may occur in addition by rotating the winding turret. In this connection, the winding cycle may proceed by rotating the winding turret, while the mount of the winding spindle is stationary, by rotating the winding turret and moving the spindle mount, or by moving the spindle mount, while the winding turret is stopped. This possibility of varying the superposed movements is especially advantageous, when it comes to change the geometric conditions between the contact roll and the package or winding spindle such that a certain contact pressure, or even a certain contact pressure profile is maintained during the winding cycle.

In a preferred embodiment of the yarn takeup machine according to the invention the spindle drive means acts to move each of the spindle mounts such that the associated spindle moves along a guide path which is at least a segment of a circle, and this guide path is tangent to the circular guide path generated by the associated spindle which is held stationary in its outer position and upon rotation of the turret. In this case, the spindle mount may be designed and constructed, for example, as a rocker arm that is supported on one side of the winding turret. This is of special advantage, in that at the beginning of the winding operation both the spindle mount and the winding turret perform an evasive movement in the same direction. Thus, a winding cycle may start likewise by rotating the winding turret.

The two spindle drive means for the two spindle mounts may be operated independently of each other and independently of the rotation of the turret. This configuration of the takeup machine has the advantage that, during a change from the winding range to the doffing range, the winding spindle moves first to an inner position. This permits the winding spindle with the full package thereon to be removed from the peripheral region of the winding turret so far that the diameter of the full package is inside the diameter of the winding turret. Thus, the takeup machine is of a very narrow construction. In the meantime, the second winding spindle may occupy a position that is favorable for receiving the yarn.

In a preferred embodiment, the mounts of the winding spindles are adapted for forward and backward movement along their guide paths. In particular, for catching the yarn on the empty tube, this facilitates rotation of the winding spindle with the empty tube into the yarn path from the outer position or from the inner position. Furthermore, this facilitates sequences of movements of the winding spindle mount during the winding, during the package doff, and during the yarn threading, without performing a rotational movement.

The takeup machine of the present invention offers an advantageous drive arrangement for the spindle mounts, when the spindle mounts take the form of two spindle turrets which are rotatably mounted to the winding turret, 180° out of phase, and along axes which are parallel to but offset from the central axis of the winding turret. On each spindle turret, a winding spindle is supported for off center rotation. The winding spindles are accordingly guided by means of the spindle turrets respectively along a circular guide path. The direction of rotation of the winding spindles is independent of the direction of rotation of the spindle turrets.

Advantageously, the drives of the spindle turrets as well as the drive of the winding turret are controlled such as to permit superimposition of the rotational movement. Thus, it is possible to vary during the winding the geometrical conditions between the contact roll and the winding spindle in different ways.

In the event that the winding turret and the winding spindle being in the doffing range are moved synchronously, it is possible to realize a guide path which results from the guide path of the spindle turret and the guide path of the winding spindle. This embodiment is especially suitable for obtaining during the entire winding cycle a substantially constant contact pressure between the contact roll and the package being wound. In this connection, it is possible to realize different forms of guide paths by varying the speed of the winding turret rotation and of the spindle turret rotation. As further parameter, it is possible to change the rotational direction of the spindle turret and the rotational direction of the winding turret.

The operation of the winding turret and the spindle turrets in the same or in the opposite direction of rotation has the advantage that the takeup machine permits both the method of corotational yarn catching and the method of counterrotational yarn catching to be realized. In the case of corotational yarn catching, the winding spindle and the yarn have the same direction of movement, whereas in the case of counterrotational yarn catching, the winding spindle is driven oppositely to the direction of the advancing yarn.

In an additional, advantageous further development of the takeup machine the drives of the spindle turrets and the drive of the winding turret are coupled with one another. This coupling between the rotational movement of the winding turret and the rotational movements of the spindle turrets may be mechanical, for example, by means of a gear drive mechanism. In this instance, the winding turret is driven by means of an electric motor. The rotational movement of the winding turret is then transmitted selectively to the spindle turrets by means of switchable gear drive means.

In a preferred variant of the embodiment, the spindle turrets and the winding turret are driven each by inverter-controlled individual motors. The coupling occurs, in this instance, by a programmable controller, which permits any desired combination of rotational movements of the spindle turrets and of the winding turret to be input to the takeup machine. In the winding range, it is thus possible to cover a predetermined profile of the contact pressure between the contact roll and the package. Furthermore, it is possible to adjust the position of the winding spindle being in the doffing range so as to maintain a height which is required by a doffer for receiving the full packages.

The takeup machine of the present invention is particularly suitable for the variants, in which the contact roll is stationary relative to the package. In this instance, it is possible to control the drive motors of the winding turret and the spindle turrets by means of a sensor, which detects the contact pressure between the package surface and the contact roll.

A control mechanism of the winding turret as disclosed in EP 0 374 536 and corresponding U.S. Pat. No. 5,029,762 may however be extended without difficulties likewise to the spindle turrets. In this instance, the movement of the contact roll, which is supported on a rocker arm, is detected and used for the control of the drives.

However, the movability of the contact roll may be used with advantage to increase the parking time. To this end, both the winding turret and the spindle turret are not driven in the winding range at the start of a winding cycle. Thus, for winding the package, the contact roll is pushed out of its position as the diameter of the package increases. After reaching the stroke limit of the contact roll, the drives of the spindle turret and/or the winding turret may be activated, so that the contact roll assumes its original position. The combination of all movements also permits the rapidly increasing diameter of the package at extremely high winding speeds to be detected.

BRIEF DESCRIPTION OF THE DRAWINGS

Further advantages and developments of the invention are described in more detail with reference to the accompanying drawings, in which.

DETAILED DESCRIPTION OF THE PREFERRED EMBODIMENTS

Figure 1:
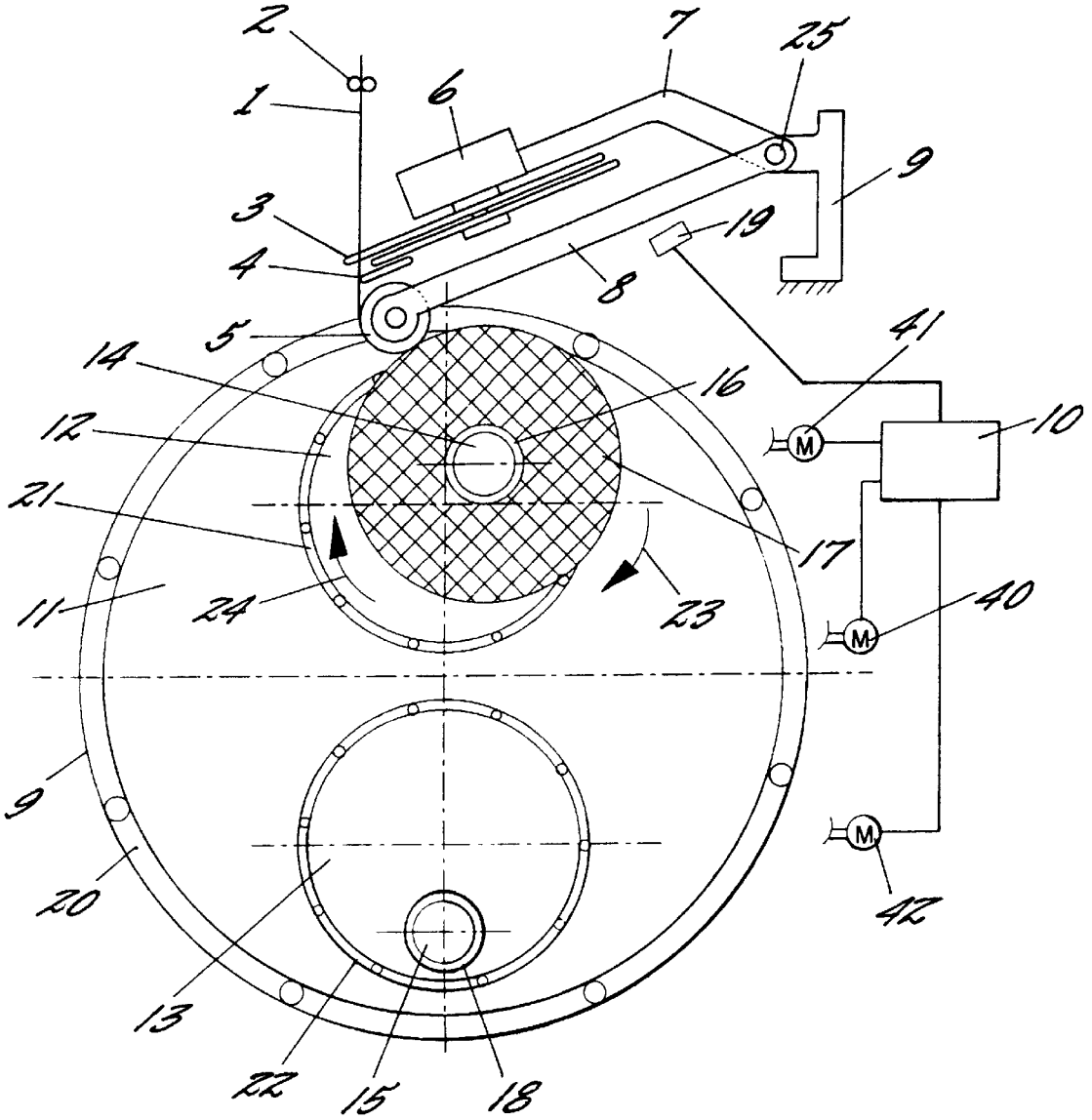
FIG. 1 is a schematic view of a yarn takeup machine during the winding operation and which embodies the present invention.

Referring more particularly to the drawings, FIG. 1 is a schematic view of a takeup machine which embodies the invention. The takeup machine comprises a winding turret 11 which is supported for rotation by means of a bearing 20 in a machine frame 9. The winding turret is driven by an electric drive motor 40. In the winding turret 11, spindle turrets 12 and 13 are supported for eccentric rotation in bearings 21 and 22. The spindle turrets 12 and 13 are arranged in the winding turret 11, 180° out of phase. The two spindle turrets 12 and 13 are driven respectively by an electric drive motor 41 and 42. Spindle turret 12 supports a winding spindle 14 projecting therefrom off center. Spindle turret 13 mounts for rotation a winding spindle 15 likewise projecting therefrom off center.

As shown in FIG. 1, the winding spindle 14 is in a winding range, and the winding spindle 15 is in a doffing range. In the illustrated position, a yarn 1 advances over a yarn guide 2 to a yarn traversing mechanism. The yarn traversing mechanism consists of a traversing drive mechanism 6 and rotary blades 3, with the mechanism 6 and blades 3 being mounted on a pivotal support arm 7. The rotary blades 3 alternately reciprocate yarn 1 along a guide edge 4 within the limits of a traverse stroke. A traversing mechanism of this general type is further disclosed in U.S. Pat. No. 5,029,762. While being traversed, the yarn advances onto a contact roll 5. The yarn 1 loops partially about contact roll 5 and is directly wound on a package 17. The package 17 is wound on a winding tube 16, and rotates along with winding spindle 14 in the direction of rotation 23. The contact roll 5 is mounted on a rocker arm 8. The rocker arm 8 and the support arm 7 are connected at a swivel joint 25 to machine frame 9. Subjacent rocker arm 8 is a sensor 19, which is connected to a controller 10. The controller 10 is connected respectively to the drive motors of the spindle turrets and to the drive motor of the winding turret.

The principle of controlling the winding operation is already known from EP 0 374 536 and corresponding U.S. Pat. No. 5,029,762, which are incorporated by reference.

As the package 17 becomes larger in the takeup machine shown in FIG. 1, the contact roll 5 is raised from its desired position, which is directly detected by sensor 19 as a change in position and converted to a signal. This signal is input to controller 10. The controller is programmed in such a manner that it activates for the time being the drive of spindle turret 12. The spindle turret 12 is moved in the rotational direction 24 of winding spindle 14, so as to increase the center distance between contact roll 5 and winding spindle 14. At this time, the drives of winding turret 11 and spindle turret 13 are inactive. In the doffing range, the winding spindle 15 is in an outer position on the winding turret. The package is already doffed, and the winding spindle 15 has received an empty winding tube 18.

The controller may be programmed as desired, so that it is also possible to start the winding cycle by rotating winding turret 11, while the spindle turret 12 is stationary. In this instance, it is especially advantageous, when both rotational movements are combined during the winding cycle, so that the winding spindle covers a resultant guide path, which prevents, for example, a fluctuation of the contact pressure between the contact roll and the package.

To further increase the parking time of the full package in the doffing range, it is also possible to move contact roll 5 radially away from package 17. In this instance, a second sensor is arranged on rocker arm 8, which interrupts at the start of the winding cycle the activation of the drives of spindle turret 12 and winding turret 11, until contact roll 5 reaches its maximum stroke.

In a further preferred embodiment of the takeup machine, the winding turret remains stopped in its position during the entire winding cycle, i.e., until the package is fully wound on tube 16. Subsequently, the winding spindle 14 is guided exclusively along a circular path, and is thereby more and more removed from an ideal spindle guide path. Thus, a maximum time is reached for doffing the winding spindle 15 in the doffing range. In this process, the winding spindle 15 is able to occupy a position on winding turret 11, which is predetermined by controller 10, which is adjusted by spindle turret 13, and which is dependent only on the requirements of a doffer.

Figure 2:
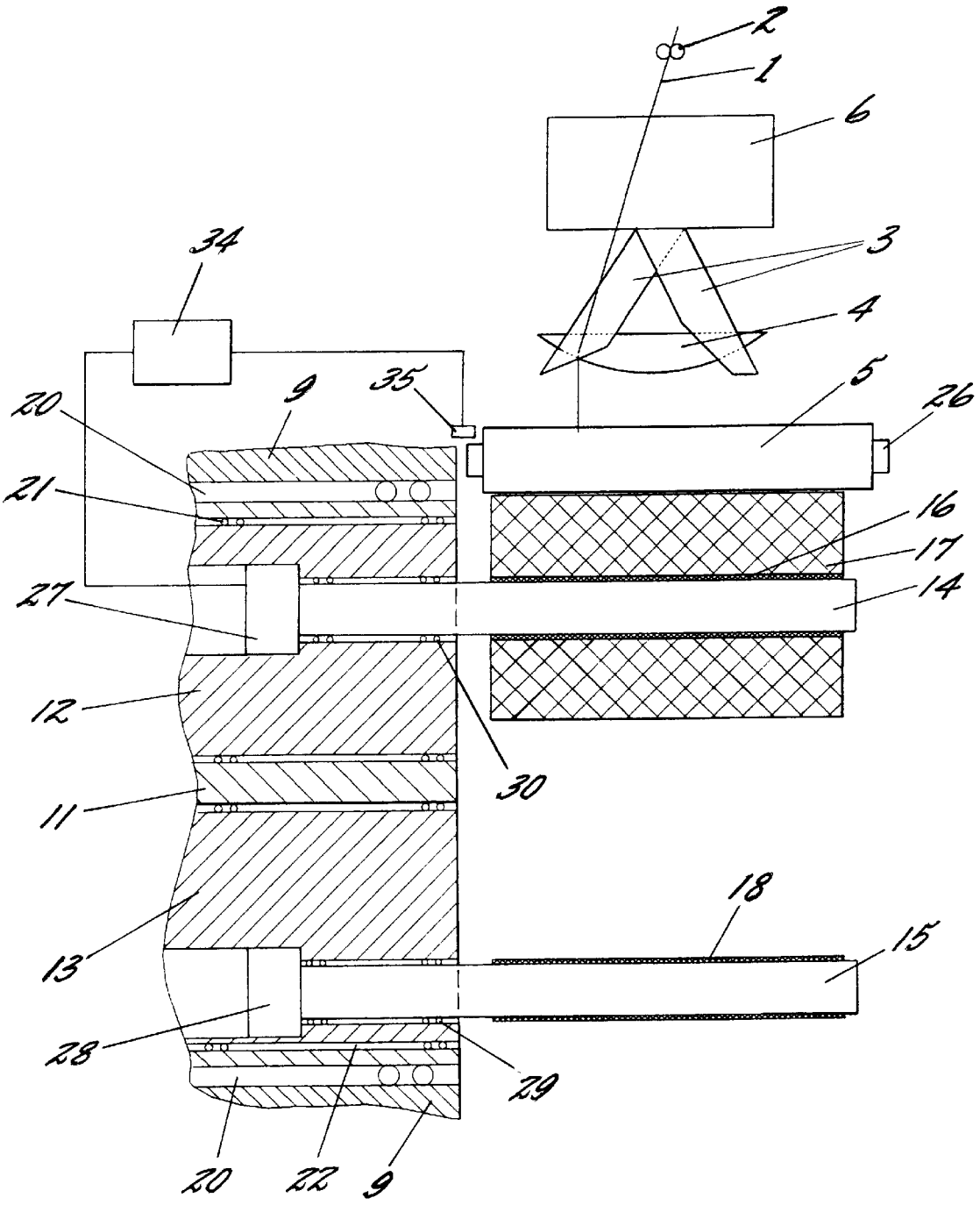
FIG. 2 is a schematic lengthwise sectioned view of the takeup machine shown in FIG. 1.

FIG. 2 is a schematic sectional view of the takeup machine of FIG. 1. In this illustration, the winding spindle 14 is in the winding range, and the winding spindle 15 in the doffing range. The winding spindle 14 is supported in spindle turret 12 by means of a bearing 30, and driven by means of a spindle drive 27. To be able to maintain a constant circumferential speed on the package surface, the speed of contact roll 5 is detected by means of a sensor 35 and supplied to a control device 34. The control device 34 converts the signals to control pulses, which are supplied to spindle drive 27, and it controls thus the drive of winding spindle 14. The winding spindle 15 is supported by means of a bearing 29 in spindle turret 13 and driven by means of spindle drive 28. Preferably, the drive motors of spindle turrets 12 and 13 are arranged in the winding turret (not shown in the Figure). The spindle turrets are driven preferably by means of a chain drive. The drive of the winding turret 11 is arranged on machine frame 9 (not shown).

Illustrated in FIGS. 3 to 6 are individual winding situations, which show advantageous methods of operation of the takeup machine in accordance with the invention. Basically, the winding spindles can be moved by different methods.

A first operating procedure may be employed which is analogous to the known procedure, and wherein the spindle turrets are stopped, and the winding turret is driven. In this instance, the winding spindle moves along an ideal, circular guide path.

A second possibility is provided wherein the spindle turrets are driven, and the winding turret is stopped. In this instance the winding spindles are moved along a circular guide path. However, this movement of the winding spindles permits only a local change in position on the winding turret. To be able to move the winding spindle from the winding range to the doffing range, it is necessary that the drive of the winding turret be likewise activated. As a result, the winding spindle is guided alternately along the guide path of the spindle turret and along the spindle guide path.

A further sequence of movements of the winding spindles is achieved by combining the rotation of the spindle turret and the rotation of winding turret. In this instance, the winding spindle is moved along a resultant guide path between the guide path of the spindle turret and the guide path of the winding spindle. The combination of the drives generates in particular elliptical guide paths. Contrary to the guide path of the winding spindle and the guide path of the spindle turret, which are defined exactly geometrically by the arrangement, the configuration of the resultant guide path is variable. Since the resultant guide path results from the combination of rotational movements, it can be influenced alone by varying the rotational speeds.

Figure 3:
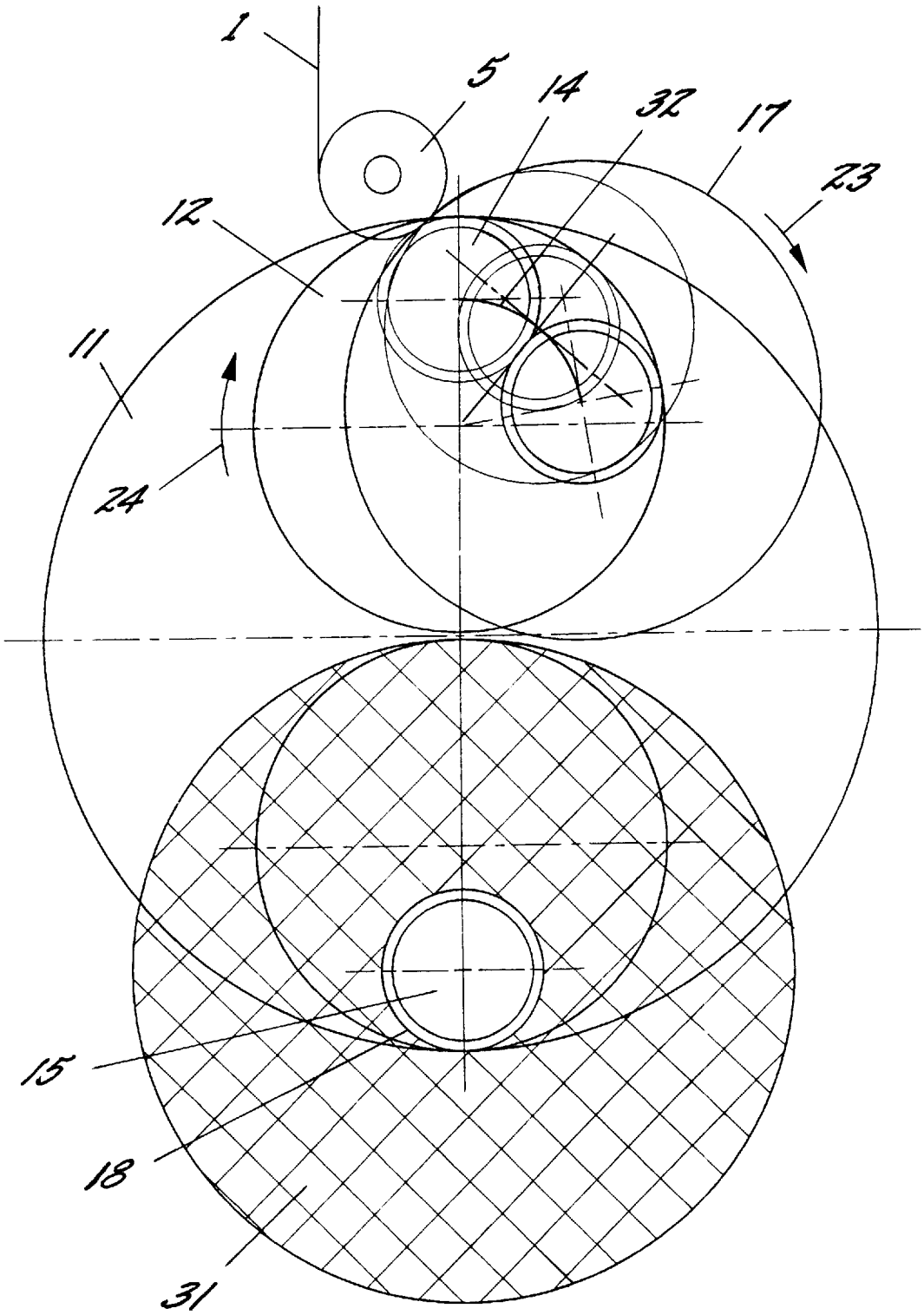
FIG. 3 is a schematic view of the takeup machine during one embodiment of the winding operation.

FIG. 3 is a schematic view of a takeup machine, which winds a yarn 1 on package 17 with a stationary contact roll 5. As illustrated, the winding spindle 14 is in the winding range and rotates in direction 23. An evasive movement for winding the yarn occurs again via the rotational movement of spindle turret 12 in the direction of rotation 24. To this end, the winding spindle 14 moves along a circular guide path 32. The second spindle turret has moved the winding spindle 15 mounted thereon to an outer position on the periphery of winding turret 11. The winding spindle 15 carries on tube 18 a fully wound package 31. The full package 31 is ready for doffing. The drives of winding turret 11 and spindle turret 13 are not activated. The drive motor may be controlled, in this instance, by spindle turret 12 via a contact pressure regulation or a package diameter-controlled regulation.

Figure 4:
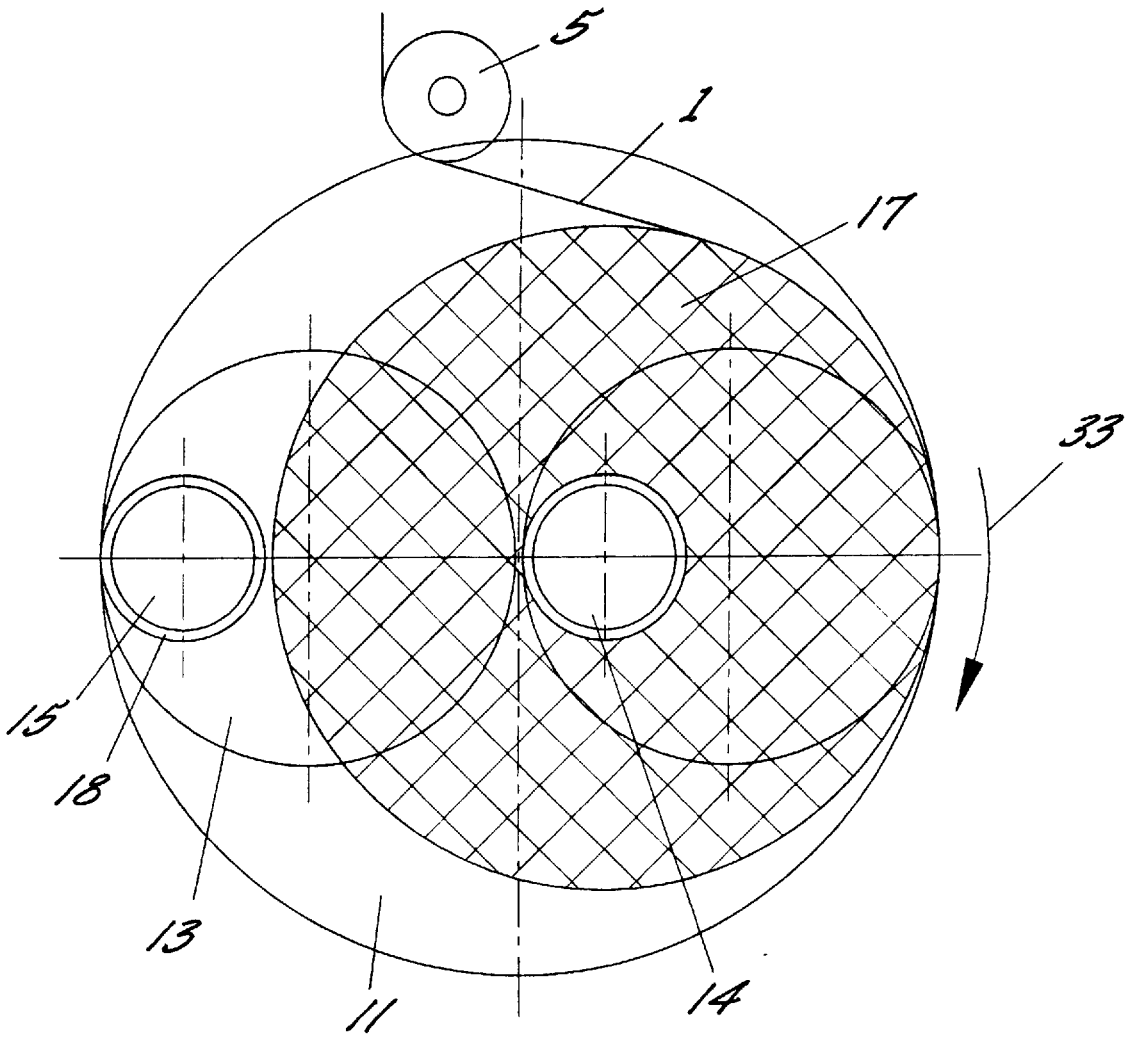
FIG. 4 is a schematic view of the takeup machine during a change from the winding range to the doffing range.

The takeup machine of FIG. 4 shows the transition of the winding spindle 14 from the winding range to the doffing range. At this point, the winding turret 11 is driven in the direction of rotation 33. In a horizontal position of winding spindle 14 relative to winding spindle 15, the spindle turret 12 has moved the winding spindle 14 to an inner position on the winding turret, whereas the spindle turret 13 has brought winding spindle 15 with empty tube 18 to an outer position. Thus, it is accomplished that the full package 17 does not project with its diameter beyond the machine frame or beyond the diameter of winding turret 11. It is therefore possible to realize a narrow machine gauge, even with large-volume, fully wound packages.

Figure 5:
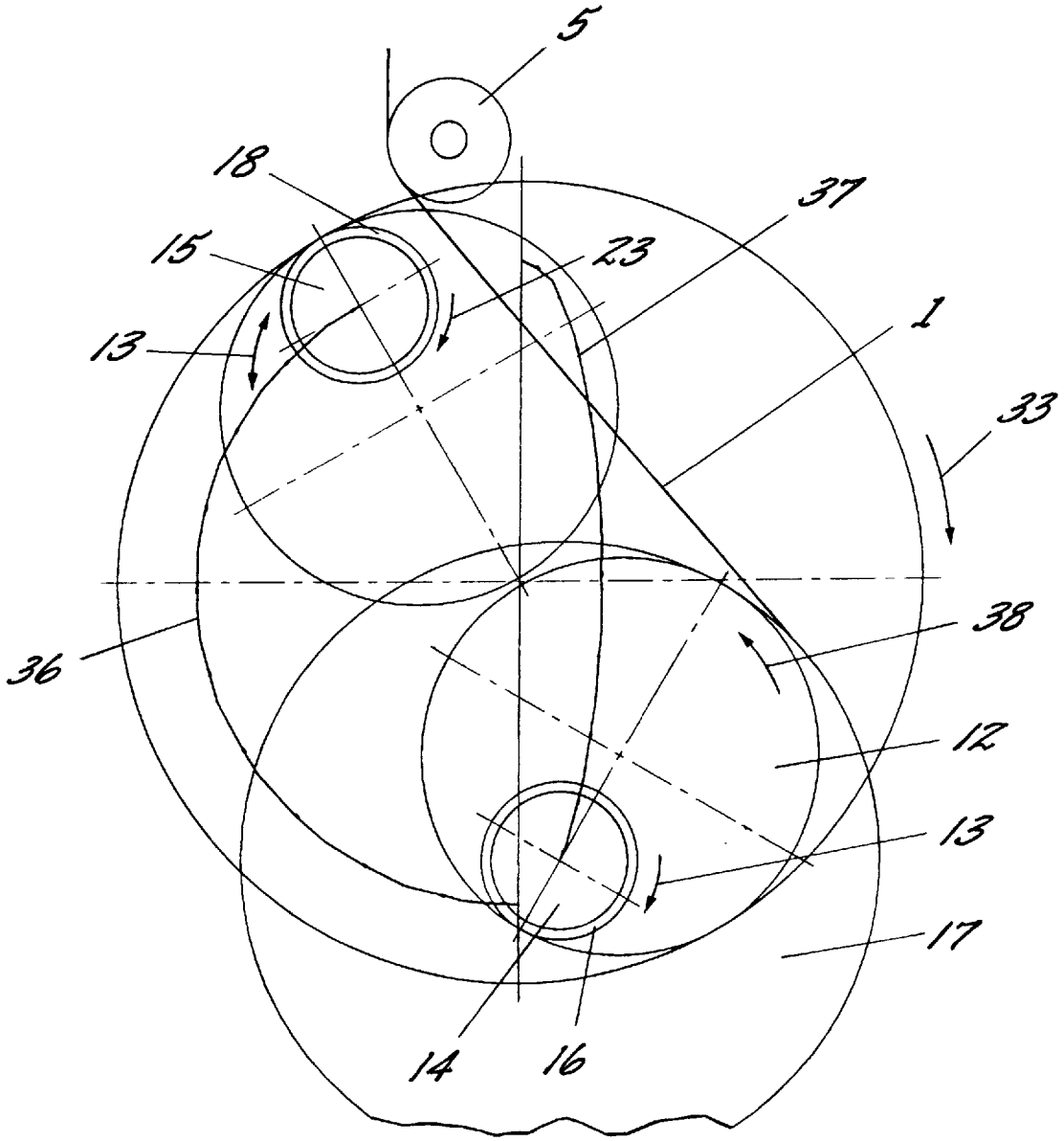
FIG. 5 is a schematic view of the takeup machine during a corotational yarn catching operation.

Shown in FIG. 5 is an embodiment, wherein the full package 17 is first wound on winding tube 16, which is driven by means of winding spindle 14. During the winding of full package 17, both the spindle turret 12 and the winding turret 11 are rotated simultaneously. In this instance, the direction of rotation 38 of spindle turret 12 is oppositely directed to the direction of rotation 33 of the winding turret. As a result of this superposed movement, the winding spindle 14 has covered an elliptical guide path 37, which was formed by superposing the rotational movement of spindle turret 12 and the rotational movement of winding turret 11. In the meantime, the drive of spindle turret 13 has remained inactive, so that the winding spindle 15 with empty tube 18 thereon has covered a circular guide path 36. Now, the winding spindle 15 on stationary spindle turret 13 is rotated into the path of yarn 1 by the rotation of winding turret 11. To assist in this rotation, the spindle turret 13 may be likewise rotated. The rotational direction of the spindle turret may be varied. With respect to the operating sequence during a yarn change, EP 0 374 536 is herewith incorporated by reference. As soon as the empty tube 18 has engaged the yarn, same tears on the side of the full package. Subsequently, the winding of the yarn continues with winding spindle 15. Once the yarn is torn between the full package 17 and empty tube 18, the winding spindle 14 is braked and moved to the doffing position.

Figure 6:
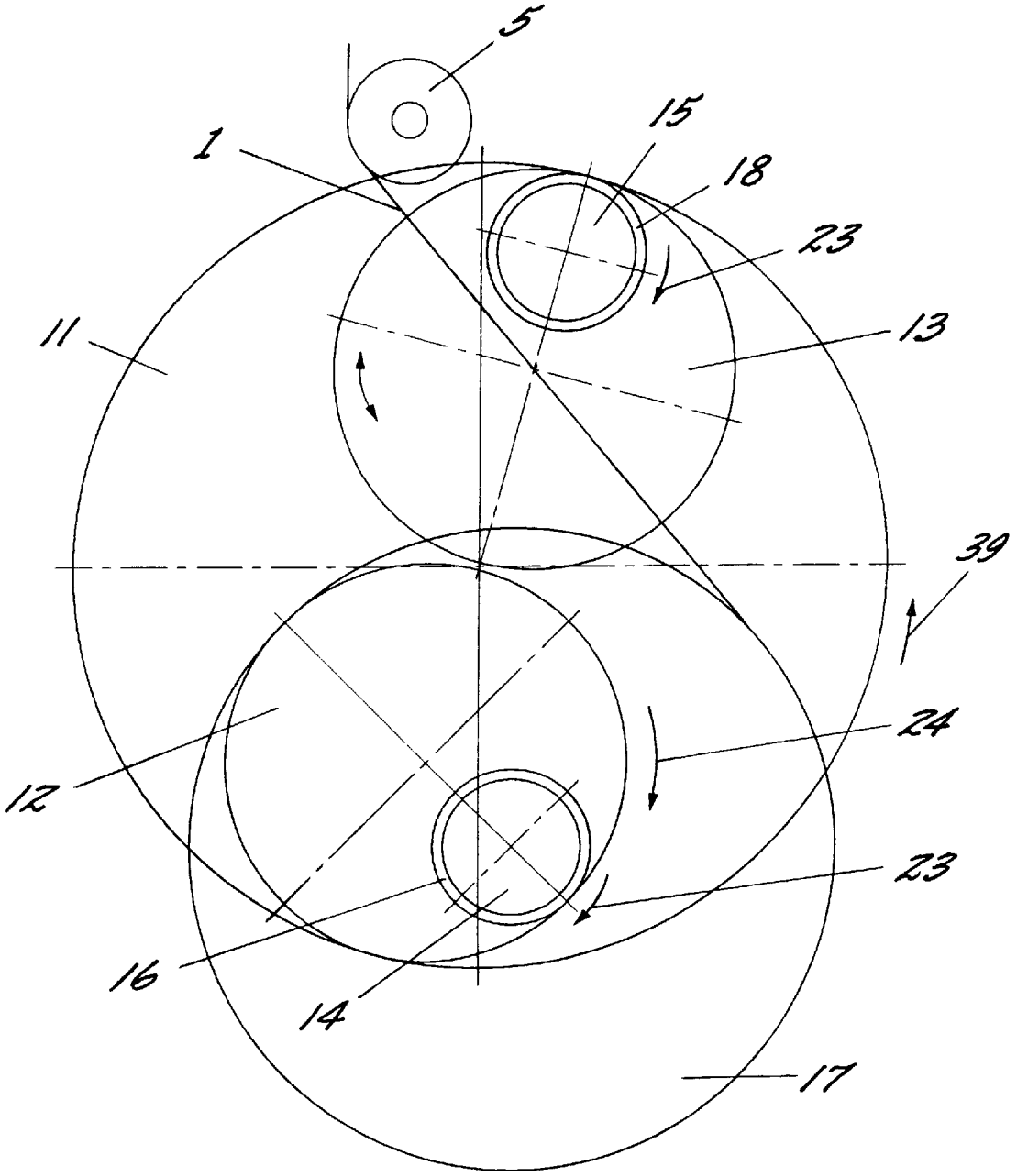
FIG. 6 is a schematic view of the takeup machine during a counterrotational yarn catching operation.

FIG. 6 illustrates the start of a winding operation in analogous manner to FIG. 5. However, in this instance, the direction of rotation 39 of the winding turret is opposite. Thus, the yarn 1 on empty tube 18, which is rotated by winding spindle 15 in the direction of rotation 23, is caught in a counterrotation. The operating sequence is yet analogous to the transition described above with reference to FIG. 5.

Basically, the yarn can be threaded on the empty tube both during a common rotation and during a counterrotation, without rotating the winding turret. To this end, the winding turret is rotated to a position, so that the yarn extending under tension between the full package and the contact roll is tangent to or travels through the guide path of the spindle turret with the empty winding spindle. Thereafter, the winding spindle with the empty tube is rotated by means of the spindle turret into the path of the yarn, and the yarn is caught by the rotating empty tube. In this instance, the spindle turret may be rotated clockwise or anticlockwise.

Figure 7:
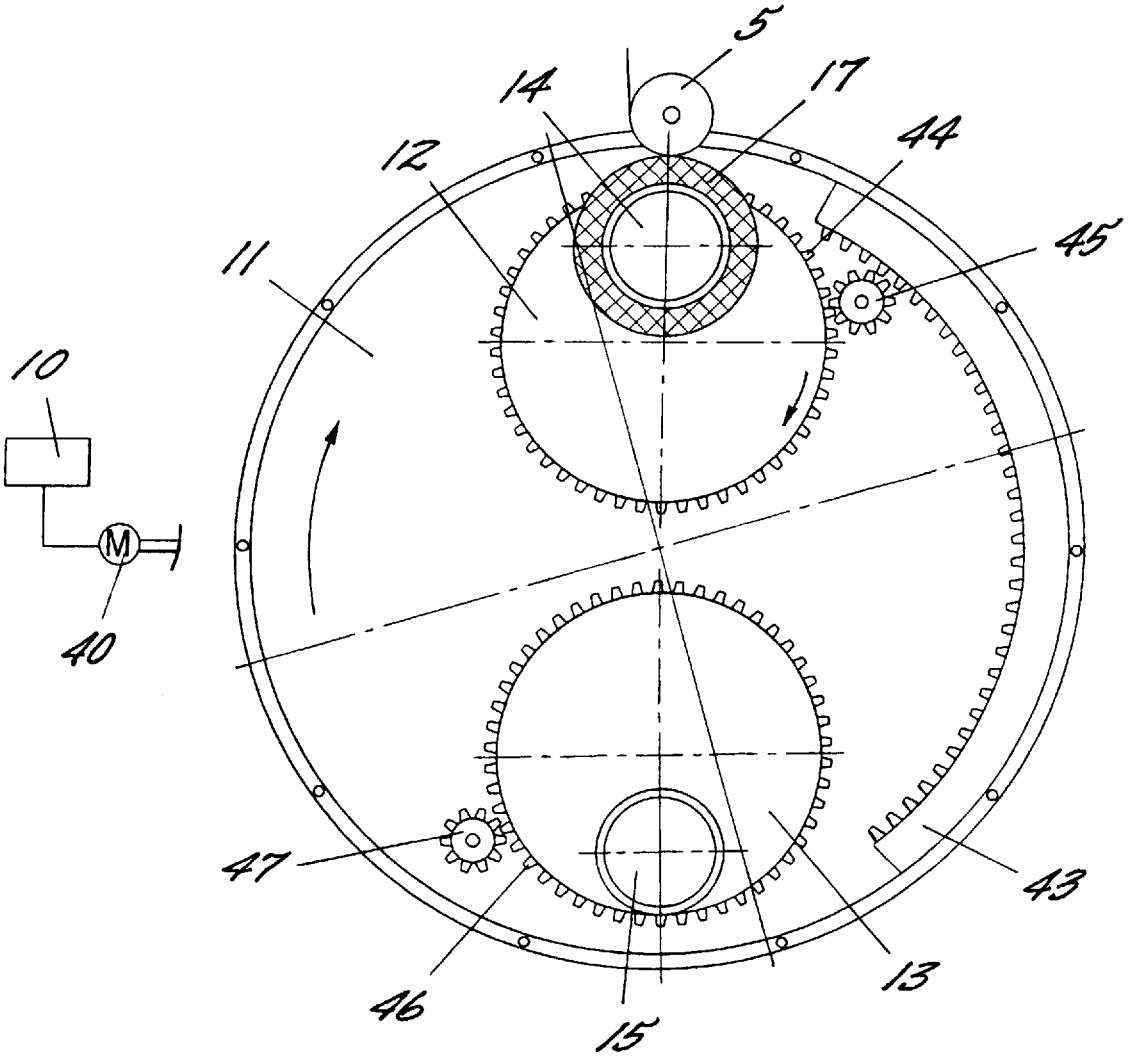
FIG. 7 is as schematic view showing a mechanical coupling of the drives of the takeup machine.

Shown in FIG. 7 is an embodiment of a takeup machine, which is provided with a mechanical coupling between the drive of winding turret 11 and the drives of spindle turrets 12 and 13. The winding turret 11 is driven for rotation by means of electric drive 40 which is controlled by controller 10. The spindle turret 12 rotatably supported in winding turret 11 and supporting winding spindle 14 is firmly connected with a gear rim 44. The gear rim 44 meshes with a pinion 45, which is supported for rotation on winding turret 11. The spindle turret 13 is likewise firmly connected with a gear rim 46. The gear rim 46 meshes with a pinion 47, which is rotatably supported on winding turret 11. In a plane parallel to winding turret 11, a toothed segment 43 is arranged stationarily. The toothed segment 43 extends over half of the circumference of winding turret 11. The gear rims 44 and 46 as well as the pinions 45 and 47 extend in one plane relative to toothed segment 43. As a result, during a rotation of winding turret 11, the pinion 45, as shown in FIG. 7, will mesh with toothed segment 43. Thus, pinion 45 follows the toothed segment 43 as the winding turret 11 continues to rotate. The rotation of pinion 45 is now transmitted to spindle turret 12, which is driven by means of gear rim 44. The rotation of spindle turret 12 continues, until the pinion 45 disengages from toothed segment 43. The rotation of spindle turret 12 occurs during the rotation of the winding turret 11 in such a manner that upon reaching the position, in which both spindle turrets 12 and 13 are opposite in the horizontal on winding turret 11, the winding spindle 14 assumes its inner position on winding turret 11.

Figure 8:
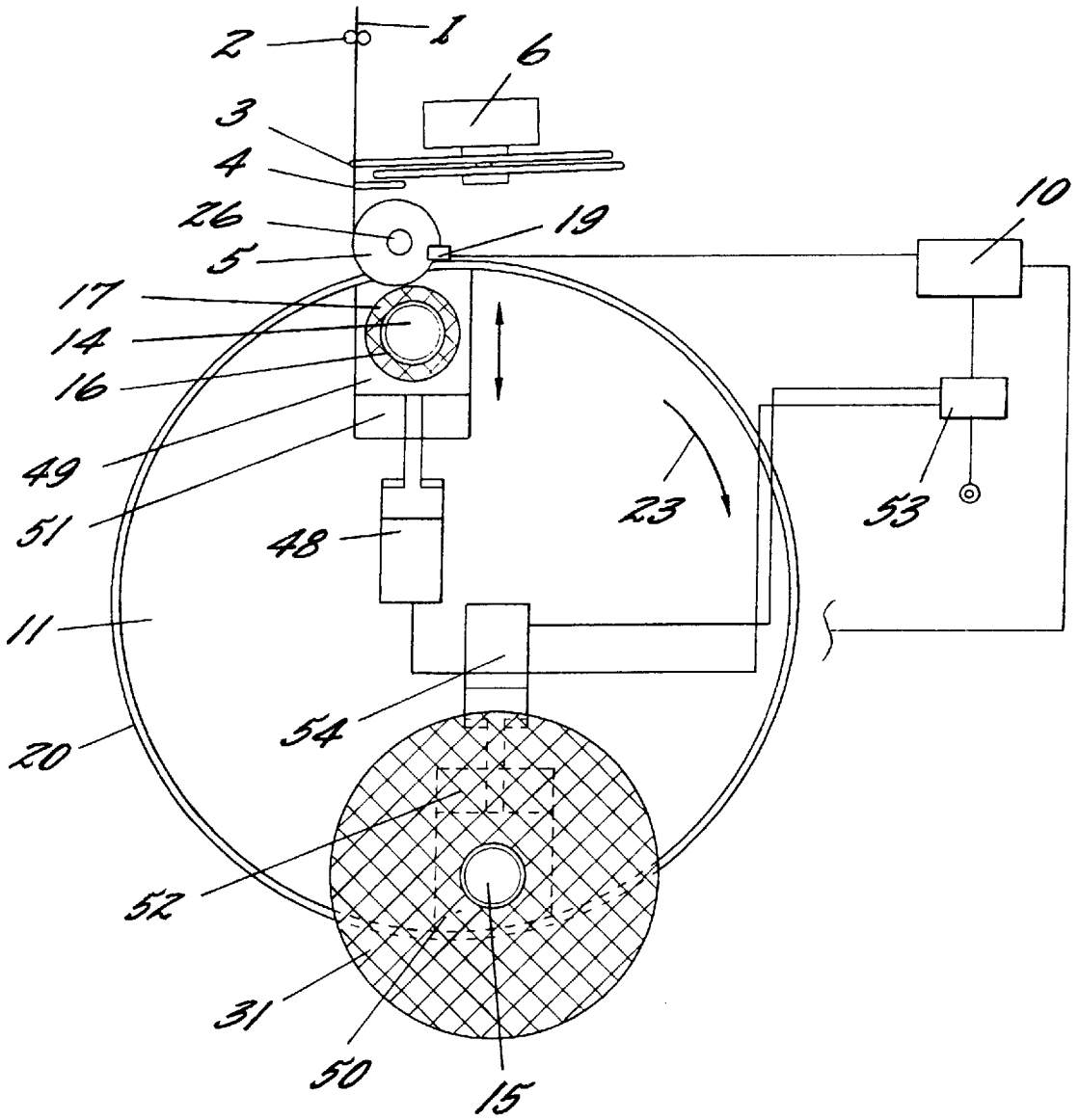
FIG. 8 is a schematic view of a further embodiment of a takeup machine according to the invention.

FIG. 8 illustrates a further embodiment of takeup machine in accordance with the invention. In this embodiment, the guide path of winding spindle 14 is formed by a linear guideway 51 and a bearing block 49. The bearing block 49 is radially displaceable on winding turret 11 by means of a linear drive 48. Thus, the linear drive 48 facilitates movement of winding spindle 14 from an outer position to an inner position. The winding spindle 15 is supported in a bearing block 50. The bearing block 50 extends in a linear guideway 52 on winding turret 11, and is moved thereon by means of a linear drive 54. In the position shown in FIG. 8, the winding spindle 15 with a full package 31 thereon is in its outer position. The linear drives 48 and 54 are controlled via a control unit 53. The control unit 53 is connected with controller 10. As described with reference to FIG. 1, the controller 10 assumes the control both of drive of the winding turret and of the linear drives.

In the drawings and specification, there has been set forth a preferred embodiment of the invention, and although specific terms are employed, they are used in a generic and descriptive sense only and not for purposes of limitation.

That which is claimed is:

1. An apparatus for continuously winding an advancing yarn into wound packages comprising a winding turret mounted to a machine frame for rotation about a central axis, rotary drive means for rotating the winding turret about the central axis, means mounting two winding spindles on said winding turret for rotation about respective axes which are parallel to said central axis, with the spindles being adapted for alternate movement between a winding range and a doffing range by rotation of the winding turret about said central axis, said mounting means for each of said spindles including a spindle mount and means mounting said spindle mount for movement on said winding turret so that the associated spindle may be moved between a radially outer position and a radially inner position and such that the associated spindle moves along a guide path which is at least a segment of a circle, and wherein the guide path is tangent to a circular guide path which is generated by the rotation of the winding turret while the associated spindle is stationary in said outer position, spindle drive means for moving each of said spindle mounts along said guide path and so that the associated spindles may be moved between said outer and inner positions, a contact roll mounted to said frame so as to be in circumferential contact with a package being wound on a spindle in said winding range, and means for controlling the rotary drive means and the spindle drive means such that each of the spindles may be moved to the winding range and then moved to increase the distance of the spindle from the contact roll as the package builds.

2. The apparatus as defined in claim 1 wherein said contact roll is supported on a pivotal rocker arm so that the contact roll is moveable in a radial direction with respect to the package being formed on the spindle in said winding range.

3. The apparatus as defined in claim 1 wherein said spindle drive means for the two spindle mounts are operable independently of each other and independently of the operation of the rotary drive means.

4. The apparatus as defined in claim 1 wherein the guide path for each of the spindles describes an arc of 180° between the inner position and the outer position.

5. The apparatus as defined in claim 1 wherein the spindle drive means is operable to selectively move each of the spindle mounts in opposite directions along its associated guide path.

6. The apparatus as defined in claim 1 wherein the guide path for each of the spindles describes a circle.

7. The apparatus as defined in claim 1 wherein each of said spindle mounts comprises a spindle turret which is rotatably mounted to said winding turret along an axis parallel to but offset from said central axis, and with the rotational axis of each spindle being offset from the rotational axis of its associated spindle turret.

8. The apparatus as defined in claim 7 wherein said spindle drive means is configured to synchronously rotate each of the spindle turrets about their respective rotational axes.

9. The apparatus as defined in claim 7 wherein said spindle drive means is configured to rotate each of the spindle turrets in a step wise movement.

10. The apparatus as defined in claim 7 wherein said rotary drive means and said spindle drive means are configured to rotate the winding turret and each of the spindle turrets in the same rotational direction.

11. The apparatus as defined in claim 7 wherein said rotary drive means and said spindle drive means are configured to rotate the winding turret in a rotational direction opposite that of each of the spindle turrets.

12. The apparatus as defined in claim 7 wherein each of the spindle turrets and the winding turret are configured for movement during the transition from the winding range to the doffing range and back in such a manner that each winding spindle circumscribes a continuous elliptical or circular guide path.

13. The apparatus as defined in claim 7 wherein each of the spindle turrets and the winding turret are configured for movement during the transition from the winding range to the doffing range such that each winding spindle circumscribes a portion of an elliptical or circular guide path.

14. The apparatus as defined in claim 7 wherein the rotary drive means and the spindle drive means are coupled.

15. The apparatus as defined in claim 7 wherein the rotary drive means and the spindle drive means each comprise individual motors, and further comprising a programmable controller for controlling the operation of the individual motors.

16. A method for winding an advancing yarn into wound packages comprising the steps of providing a winding turret mounted to a machine frame for rotation about a central axis, means mounting two winding spindles on said winding turret for rotation about respective axes which are parallel to said central axis, with the spindles being adapted for alternate movement between a winding range and a doffing range by rotation of the turret about said central axis, said mounting means for each of said spindles including a spindle mount and means mounting said spindle mount for movement on said winding turret so that the associated spindle may be moved between a radially outer position and a radially inner position and such that the associated spindle moves along a guide path which is at least a segment of a circle, and wherein the guide path is tangent to a circular guide path which is generated by the rotation of the winding turret while the associated spindle is stationary in said outer position, controlling the rotation of the winding turret and the movement of the spindle mounts such that each spindle may be moved to the winding range and then moved by superposing the rotational movement of the winding turret and the movement of the associated spindle mount as the package builds, and delivering an advancing yarn to each winding spindle when the winding spindle is in the winding range so as to wind a yarn package thereon.

17. The method as defined in claim 16 wherein each of said spindle mounts comprises a spindle turret which is rotatably mounted to said winding turret along an axis parallel to but offset from said central axis, and with the rotational axis of each spindle being offset from the rotational axis of its associated spindle turret.

18. The method as defined in claim 17 wherein the controlling step includes rotating the spindle turret of the spindle positioned in the winding range such that such spindle moves along a guide path which constitutes a segment of a circle, and wherein the direction of rotational movement along the guide path is the same as the rotational direction of the turret.

19. The method as defined in claim 17 wherein the controlling step includes rotating the spindle turret of the spindle positioned in the winding range such that such spindle moves along a guide path which constitutes a segment of a circle, and wherein the direction of rotational movement along the guide path is opposite the rotational direction of the turret.

20. The method as defined in claim 17 wherein the controlling step includes rotating the spindle turret of the spindle positioned in the winding range such that such spindle moves along a guide path which constitutes at least a segment of a circle, and wherein the angular speed of the rotational movement of the associated spindle along the guide path is the same as the angular rotational speed of the turret.

21. The method as defined in claim 17 wherein the controlling step includes rotating the spindle turret of the spindle positioned in the winding range such that such spindle moves along a guide path which constitutes at least a segment of a circle, and wherein the angular speed of the rotational movement of the associated spindle along the guide path is different from the angular rotational speed of the turret.

* * * * *